United States Patent [19]

Wild

[11] Patent Number: 4,815,433

[45] Date of Patent: Mar. 28, 1989

[54] METHOD OF AND DEVICE FOR CONTROLLING AND/OR REGULATING THE IDLING SPEED OF AN INTERNAL COMBUSTION ENGINE

[75] Inventor: Ernst Wild, Weissach, Fed. Rep. of Germany

[73] Assignee: Robert Bosch GmbH, Stuttgart, Fed. Rep. of Germany

[21] Appl. No.: 110,558

[22] PCT Filed: Jul. 27, 1985

[86] PCT No.: PCT/DE85/00254

§ 371 Date: Apr. 9, 1986

§ 102(e) Date: Apr. 9, 1986

[87] PCT Pub. No.: WO86/01257

PCT Pub. Date: Feb. 27, 1986

Related U.S. Application Data

[63] Continuation of Ser. No. 862,503, Apr. 9, 1986, abandoned.

[30] Foreign Application Priority Data

Aug. 9, 1984 [DE] Fed. Rep. of Germany ..... 3429351

[51] Int. Cl.[4] ..... F02D 41/16

[52] U.S. Cl. ..... 123/339; 123/362

[58] Field of Search ..... 123/339, 340, 350, 352, 123/362

[56] References Cited

U.S. PATENT DOCUMENTS

| | | | |
|---|---|---|---|
| 4,305,360 | 12/1981 | Meyer et al. | 123/339 |
| 4,545,348 | 10/1985 | Ikeura | 123/340 |
| 4,567,869 | 2/1986 | Peter et al. | 123/339 |
| 4,597,047 | 6/1986 | Deutsch | 123/339 |

*Primary Examiner*—Andrew M. Dolinar

*Attorney, Agent, or Firm*—Michael J. Striker

[57] ABSTRACT

A method and a device for controlling and/or regulating the idling speed of an internal combustion engine is suggested, wherein changes of the operating condition of the internal combustion engine are considered by means of a precontrol being dependent from operational characteristics dimensions of the internal combustion engine, as well as being stabilized during long term changes of the operational condition of the internal combustion engine with the assistance of a correction of the precontrol. Thereby, it is differentiated between a direct correction as well as an indirect correction, for example, additive correction of the precontrol. Block diagrams are provided for both correction possibilities. Also, a plurality of criteria are stated with the assistance of which the time range of the correction may be defined. For realizing the method with the assistance of a corresponding programmed electronic computer the precontrol and the correction for the precontrol are designed in form of support locations with intermediately disposed interpolations in one exemplified embodiment.

19 Claims, 3 Drawing Sheets

METHOD OF AND DEVICE FOR CONTROLLING AND/OR REGULATING THE IDLING SPEED OF AN INTERNAL COMBUSTION ENGINE

This application is a continuation of application Ser. No. 862,503, filed Apr. 9, 1986, now abandoned.

BACKGROUND OF THE INVENTION

The invention relates to a method and a device for controlling and/or regulating the idling speed of an internal combustion engine.

It has been known to take into consideration the operating state of an internal combustion engine for regulating the idling speed. The regulation of the idems speed has been performed, for example, by determines idling speed values for defined operating conditions of the internal combustion engine and regulating the speed of the internal combustion engine based on these predetermined values. Generally, with the assistance of the known precontrols it has been possible to quickly stabilize changes in the operating state of the internal combustion engine, for example, the load change of the internal combustion engine during switching on an air conditioning unit, for example, during the regulating of the idling speed of the internal combustion engine.

With each internal combustion engine not only short term changes in the operational state occur, like, for example, the mentioned load jump during the switching on of the air conditioning unit, but the operational state of the internal combustion engine also causes long term changes. Such long term changes are mostly caused by aging effects of the total internal combustion engine. These long term changes have not taken into consideration in the known idling speed regulating, consequently, the idling speed could not been regulated to optimal values for a long term by the known idling speed regulator, so that the transmissions to the idling speed were performed with higher or lower oscillations of the speed of the internal combustion engine.

SUMMARY OF THE INVENTION

In is an object of this invention to provide an improved method and device for controlling the idling speed of an internal combustion engine.

In contrast to the above described conventional methods the method for controlling and/or regulating the idling speed of an internal combustion engine according to the invention is advantageous in that long term changes of the operational state of the internal combustion engine can be considered during the regulation of the idling speed of the internal combustion engine due to the correction of the precontrol of the idling speed regulation which is dependent from the operational state of the internal combustion engine.

In accordance with the invention two possibilities of the correction of the precontrol of the idling speed regulation of the internal combustion engine are provided, namely the direct correction, that is, the change of the precontrol values themselves or the indirect correction, that is, the change of the precontrol values by the addition of correcting values.

Generally, the method in accordance with the invention provides an optimal building up of the speed of the internal combustion engine into the idling speed, for example, from the operational conditions with the partial load or the switching off signal.

DETAILED DESCRIPTION OF THE PREFERRED EMBODIMENTS

The described exemplified embodiments relate to the control and/or the regulation of the idling speed of an internal combustion engine. This idling speed regulation can be generally used in conjunction with internal combustion engines, that is, in conjunction with Otto-internal combustion engines, with Diesel-internal combustion engines, etc. Also, the exemplified embodiments described herein below are not limited to any specific circuit arrangements, but they can be realized in any embodiment being obvious to a person skilled in the art, for example, in the analog or digital shifting control technique with the assistance of a correspondingly programmed microcomputer, etc.

Figure 1:
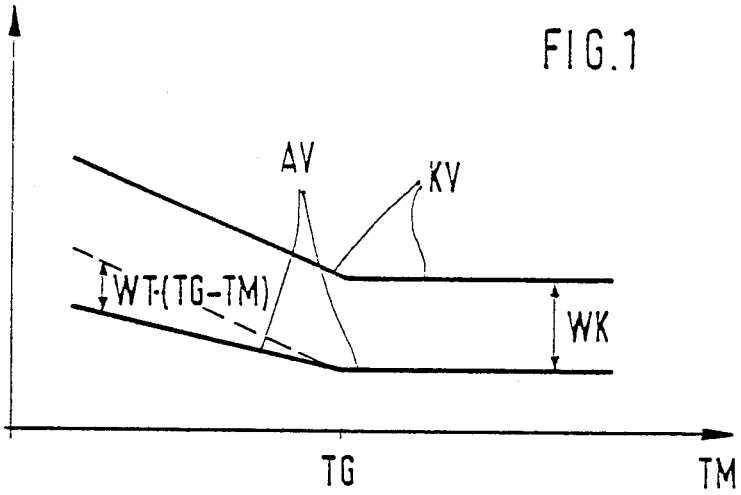
FIG. 1 illustrates an indirect correction of the precontrol of the idling speed of an internal combustion engine.

FIG. 1 illustrates an indirect correction of the precontrol of the idling speed regulation of an internal combustion engine. The motor temperature $T_M$ is illustrated on the horizontal axis of the diagram, whereby the limit temperature $T_G$ is particularly shown on this axis. This limit temperature $T_G$ is the motor operating temperature of the internal combustion engine during normal operation. The characteristics curves illustrated in the diagram are a performance graph-precontrol signal KV, on the one hand, and an adapted precontrol signal AV, on the other hand. The constant distance between the performance graph precontrol signal KV and the adapted precontrol signal AV is illustrated in the diagram of FIG. 1 by the constant value WK. The deviation of the adapted precontrol signal AV from the performance graph precontrol signal KV from the constant value WK is illustrated in the diagram of FIG. 1 by the value WT ($T_G-T_m$) wherein WT designates a temperature dependent value, while $T_G$, as already stated, the limit temperature, and $T_M$ represents the motor temperature.

The performance graph precontrol signal KV illustrated in the diagram of FIG. 1 is a signal which is stored in any given form in a storage and whose size depends from the operational state of the internal combustion engine. For example, if the operational state of the engine is changed by switching on the air conditioning unit, the performance graph precontrol signal changes simultaneously with this change. The desired idling speed of the internal combustion engine is more rapidly reached with the assistance of the performance graph precontrol signal KV. The heretofore described operations are known. The long term changes of the operational state of the internal combustion engine can be considered by the precontrol if the adapted precontrol signal AV is used according to the subject invention for the idling speed regulation in place of the performance graph precontrol signal KV. This adapted precontrol signal AV results from the graph performance precontrol signal in accordance with the diagram of FIG. 1 due to the following two equations:

$$AV=KV+WK+WT\,(T_G-T_M) \text{ for } T_M \leqq T_G$$

and $$AV=KV+WK \text{ for } T_M>T_G.$$

Accordingly, the performance graph precontrol signal KV is displaced above the limit temperature $T_G$ by the constant value WK toward the adapted precontrol signal AV, while the performance graph precontrol signal KV is displaced below the limit temperature $T_G$ not only by the constant value WK, but also simultaneously its gradient is changed in dependency from the temperature dependent value WT. The constant value WK and the temperature dependent value WK may be positive or negative values.

The change of the performance graph precontrol signal KV towards the adapted precontrol signal AV, illustrated in the diagram of FIG. 1, is only one possibility of such a change. In accordance with the invention it is also possible to change the performance graph precontrol signal KV toward the adapted precontrol signal AV in any given manner, for example, by a parallel displacement of KV toward AV over the total range of the motor temperature $T_M$. With such an exemplified simplification of the diagram of FIG. 1, there are corresponding resulting simplifications of the realisation of the diagram of FIG. 1 (FIG. 2).

Figure 2:
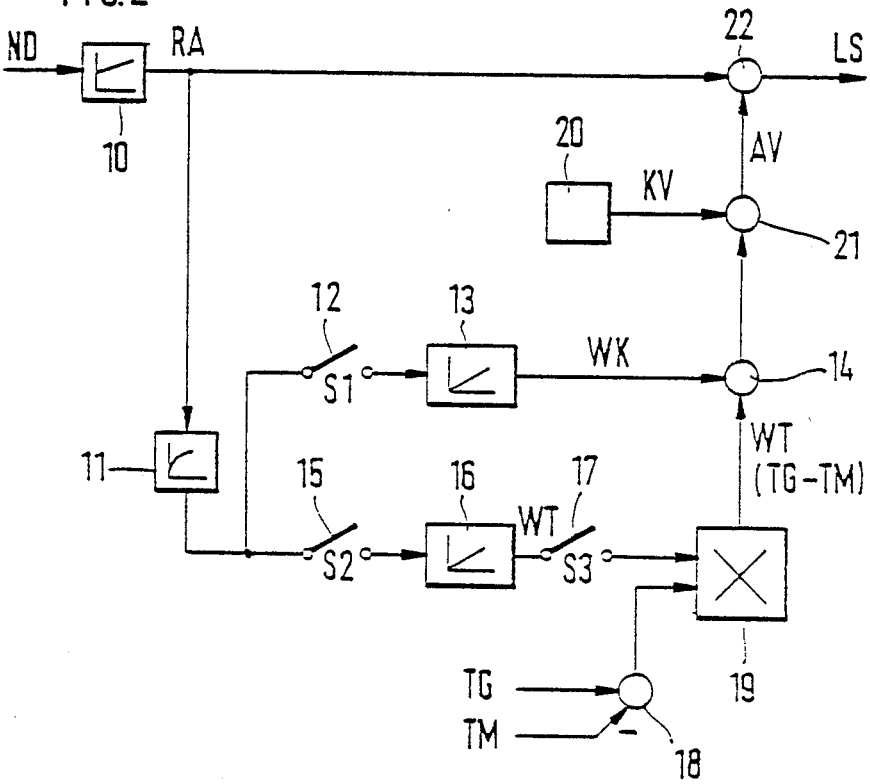
FIG. 2 is a schematic diagram of the realisation of the indirect correction of FIG. 1.

FIG. 2 illustrates a realisation of the indirect correction of FIG. 1. An idling speed regulator is designated with reference numeral 10 and has an integral component. The reference numeral 11 indicates a low pass. The switch S1 is designated with the reference numeral 12 and the switch S2 with the reference numeral 15. One integrator is designated with the reference numeral 13 and the other integrator-with the reference numeral 16. The reference numeral 17 denotes switch S3. Connecting locations are designated with the reference numerals 14,18, 21 and 22. A multiplicator is designated with the reference numeral 19. Finally, a precontrol performance graph is designated with the numeral reference 20. The idling speed regulator 10 forms a control output signal RA in dependency from its input signal which is a speed differential signal ND. The output signal RA is then fed to the low pass 11, on the one hand, and to the connecting location 22, on the other hand. The low pass 11 forms an output signal dependent from signal RA, which is fed to the two switches 12 and 15. Each integrator 13, 16 is switched subsequent to each of the two switches, that is, the integrator 13 to switch 12 and the integrator 16 to switch 15. On the one hand, switch 17 is connected with the output of the integrator 16 and, on the other hand, with an input of the multiplicator 19. The other input of the multiplicator 19 is admitted by the output signal of the connecting location 18, whose input signals consist of the limit temperature $T_G$ and the motor temperature $T_M$. The multiplicator forms an output signal in dependency from its two input signals which is designated in FIG. 2 with the formulae WT $(T_G-T_M)$. This output signal of the multiplicator 19, as well as the output signal of the integrator 13, which is designated with WK are fed to the connecting location 14. The output signal of the connecting location 14, as well as the output signal of the precontrol performance graph 20, which is designated with KV, are connected to connecting location 21. In dependency from its input signals the connecting location 21 forms an output signal AV fed to the connecting location 22. This connecting location 22 finally forms from their input signals the output signal LS which is an idling speed set signal.

With the assistance of the block diagram of FIG. 2 it is possible to realise the displacement of the performance graph precontrol signal KV toward the adapted precontrol signal AV illustrated in FIG. 1. The values WK and WT which determine this displacement are dependent from the control output signal RA, as well as from the switch positions of the two switches 12 and 15. The two values WK and WT are intermediately stored by means of the two integrators 13 and 16.

The switch S1 closes when the internal combustion engine is in its disconnected state and when the motor temperature $T_M$ is greater than the limit temperature $T_G$. The disconnected state of the internal combustion engine can be determined, for example, in that the total of the speed differential signals ND is smaller than a defined, predetermined speed differential threshold and that also the control output signal RA is smaller than a defined, predetermined control output threshold. When the switch S1 is closed, also when $T_M>T_G$ is in the decoupled state, it means that the performance graph precontrol signal KV of the precontrol performance graph 20 is only corrected by signal WK acting through switch S1. Generally in this state AV=KV+WK, as stated in the description with respect to FIG. 1.

Switch S2 closes exactly when the internal combustion engine is in its uncoupled state and when the motor temperature $T_M$ is smaller than the limit temperature $T_G$. This means that the temperature dependent value WT changes only when switch S2 is closed. The output signal of the multiplicator 19 cannot supply an output signal because of the closing of switch S2. Only when switch S3 is closed, the multiplicator generates an output signal which is uneven zero. Switch S3 is closed exactly when the motor temperature $T_M$ is smaller than the limit temperature $T_G$ independently from the other condition of the internal combustion engine. Generally this means that a signal is available at the output of the multiplicator 19 when the switch S3 is closed, having the value WT $(T_G-T_M)$. When switch S2 is opened, this value changes only in dependency from the limit temperature $T_G$ and the motor temperature $T_M$. If switch S2 is closed, the output signal of the multiplicator 19 changes also in dependency from the temperature dependent value WT. When switch S3 is closed the following equation prevails for the adapted precontrol signal: AV=KV+WK+WT $(T_G-T_M)$, as has been described in conjunction with the description of FIG. 1. Not only the temperatures $T_G$ and $T_M$ can change on account of the integrators 13 and 16 in this equation in dependency from the switch positions of switches S1 and S2, but also the values WK and WT.

If only the performance graph precontrol signal KV had been connected with the regulation output signal RA for the idling speed set signal LS in the hitherto known state of the art, now a correction of the performance graph precontrol signal KV toward the adapted precontrol signal AV is possible in accordance with FIG. 2. As had been already illustrated in conjunction with the description of FIG. 1 it is possible to simplify the characteristic curve of the performance graph precontrol signal KV and accordingly the block diagram of FIG. 2. Also, in accordance with the invention it is possible to realise the correction of the performance graph precontrol signal KV not only indirectly with the assistance of an additive connection, but also directly by changing the performance graph precontrol signals directly in the precontrol performance graph 20. Such a realisation is described in the following in conjunction with the exemplified embodiments of FIGS. 3, 4 and 5.

Independently from whether an indirect correction of the precontrol, as illustrated in FIGS. 1 and 2, is performed or a direct correction of the precontrol as will be explianed in the following description, is executed the total operation of the correction of the precontrol is based on that an output signal different from zero feeds the subsequent integrators during correspondingly closed switches, thus changing their output values accordingly. This change of the integrator output values results in a change of the precontrol signal, which in turn results in a change of the idling speed set signal. This total operation is performed until the regulator output signal is zero. Generally, an error, which had been generated on account of the fixed predetermined values of the precontrol and which cannot be stabilized by the idling speed regulator with a limited regulating stroke, is completely corrected by the correction of the precontrol. Furthermore, the transmission ratio during the transmission into the idling speed is improved.

Figure 3:
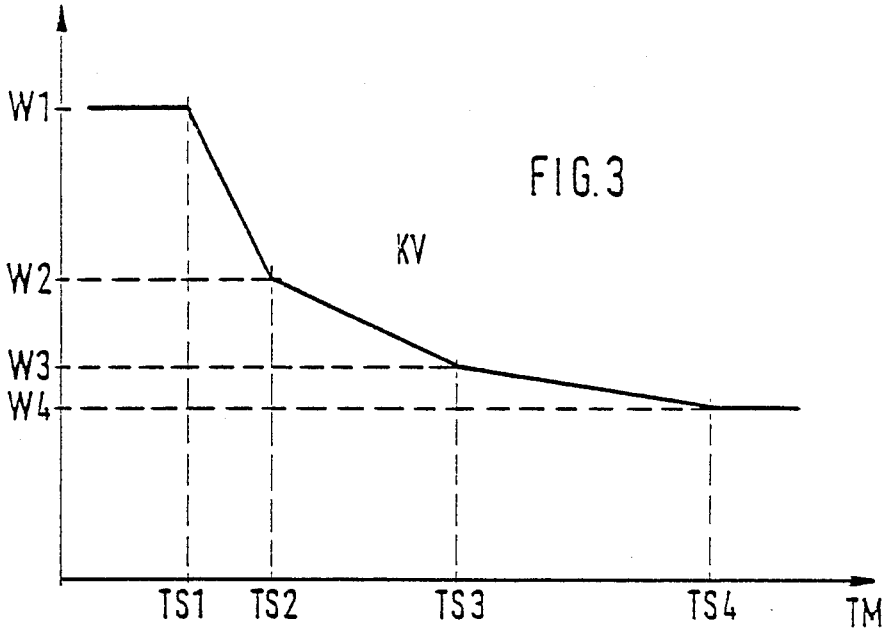
FIG. 3 is a graph showing a direct correction of the precontrol of the idling speed regulation of an internal combustion engine.

FIG. 3 now illustrates the direct correction of the precontrol of the idling speed of an internal combustion engine. In the diagram of FIG. 3, the motor temperature $T_M$ is illustrated on the horizontal axis, wherein defined temperature threshold values TS1,TS2,TS3 and TS4 are particularly designated. Output signals are illustrated on the vertical axis of the diagram of FIG. 3, whereby the values W1,W2,W3 as well as W4 are particularly designated. The diagram of FIG. 3 generally illustrates the characteristic curve of the performance graph-precontrol signal KV as a function of the motor temperature $T_M$. This characteristic curve KV of FIG. 3 is comparable with the characteristic curve KV of FIG. 1 Generally, the chracteristics curve KV of FIG. 3 is formed by four support locations which are connected with each other by straight lines. Thereby, it is possible to substantially improve the characteristics curve KV of FIG. 3 in comparison with the graph of FIG. 1. It is naturally also possible to introduce even more support locations and thereby illustrate an almost nonlinear characteristics curve KV.

Figure 4:
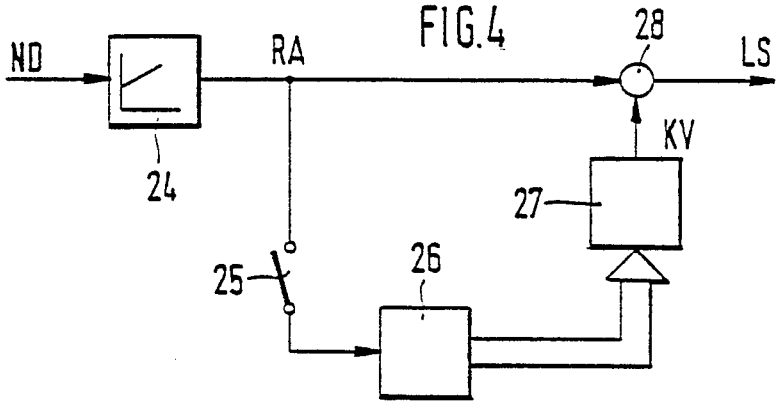
FIG. 4 is a schematic diagram of the realisation of the direct correction of FIG. 3.
Figure 5:
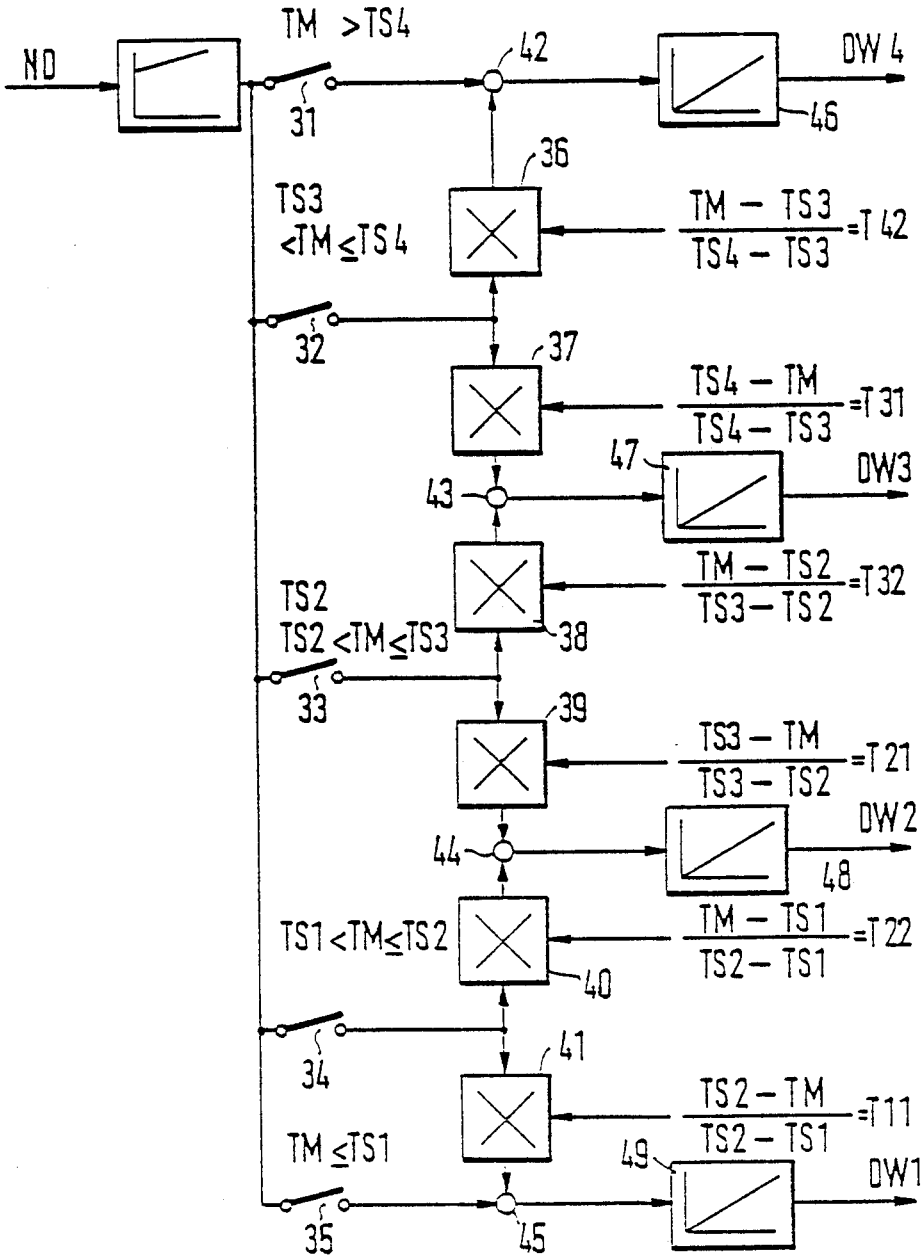
FIG. 5 is a schematic diagram illustrating the correction device of FIG. 4

The direct correction of the precontrol of the idling speed regulation described in FIGS. 3,4 and 5 relates to a device with a correspondingly programmed electronic computer. For this reason the values W1 . . . W4 of the support locations TS1 . . . TS4 are sufficient for the computer in FIG. 3. All output values which are positioned between the aforementioned values are calculated by the computer by an interpolation which is adapted to the given case of application. For the correction of the performance graph precontrol signal KV of FIG. 3 it is not necessary to change the total characteristic curve, as is the case in the indirect correction in accordance with FIG. 1, but it suffices in this case to correct only the four support locations. Due to the interpolation the correction of the supporting locations acts on the total performance graph precontrol signal characteristics curve KV.

FIG. 4 illustrates a realisation of the direct correction of FIG. 3. The reference numeral 24 designates an idling speed regulator with an I-component. A switch is designated with the reference numeral 25. The reference numeral 26 designates a correcting device, while a precontrol performance graph is designated with the numeral reference 27. A connecting location is designated with the reference numeral 28. The speed differential signal ND is fed as an input signal to the idling speed regulator 24. Independently from its input signal the idling speed regulator 24 forms the output signal RA which is connected to the switch 25 and to the connecting location 28. The correction device 26 is also connected with switch 25. The output signals are fed from the correction device 26 to the precontrol performance graph 27. Finally, the output signal of the precontrol performance graph 27, which is characterized with signal KV, is connected to the connecting location 28 which independently from its input signals, forms the output signal LS which is an idling speed set signal.

As already stated, the correction device 26 generates signals when switch 25 is closed and when the control output signal RA is different from zero, with the assistance of which the precontrol of the idling speed regulation is corrected. As had been already stated the correction is performed directly in the circuit illustrated in the block diagram of FIG. 4, that is, by a direct changing of the values of the precontrol performance graph 27. Since in the described exemplified embodiment only the four values W1 . . . W4 of the four supporting locations TS1 . . . TS4 in the precontrol performance graph 27 are stored, a correction of these values is possible in a particularly advantageous manner. Generally, the four values of the precontrol performance graph 27 are changed with the assistance of the correcting device until the regulating signal RA becomes zero during the closed switch 25.

Since with the realisation of the correction of the precontrol with the assistance of the block diagram of FIG. 4, due to the distribution of the operational range of the motor temperature $T_M$ with the assistance of the supporting locations TS1 . . . TS4, a consideration of limit temperatures is no longer required, as is the case in the realisation of the correction of the precontrol in accordance with FIG. 2, switch 25 is exactly closed when the internal combustion engine is in its decoupled state.

It is now possible to recognize the decoupled operational condition with the assistance of the speed differential signal ND and the control signal RA, as had been already illustrated in conjunction with the description of FIG. 2. However, the first recognition possibility requires a first adaptation, that is, immediately after the internal combustion engine had been manufactured the two threshold values for the speed differential and the regulating output signal must be so set on the engine test stand that a safe recognition of the decoupled condition be made possible.

It is therefore particularly advantageous to determine the decoupled operational condition of the internal combustion engine by means of the following method. By means of tests and experiments it had been shown that the speed drop, for example, from the partial load range to the idling speed range engine coupled condition takes place substantially slower than in the decoupled operational condition. This means that at a corresponding determination of the theoretical value speed drop, the actual speed drop in the decoupled operational condition of the internal combustion engine deviates only slightly from the stated theoretical value speed drop. However, in the coupled operational condition this deviation is substantially larger. This difference can be used for the recognition of the decoupled operational condition of the internal combustion engine in such a manner that after a defined, predetermined time period after the entering of the actual value into the control range of the idling speed regulating, the difference between the desired theoretical speed and the real actual speed is tested. If this difference exceeds a defined, predeterminable threshold, it means that the internal combustion engine is in a coupled condition. However, if the difference is smaller than the predetermined threshold, it means that the internal combustion engine is in its decoupled operational condition. The particular advantage of this realisation of the decoupled operational condition is that the difference of the speed drop in the coupled and decoupled internal combustion engine is so large in all types of the internal combustion engines made that the predeterminable threshold value must not be set for each individual internal combustion engine on the engine test stand, but can be determined only once. A first adaptation is not required with this realisation with the assistance of the speed drop, as is the case with the realisation described in conjunction with the block diagram of FIG. 2. Naturally it is possible to use the latter described realisation also with the realisation with the device of FIG. 2.

A further specific possibility of recognizing the decoupled operational condition of the internal combustion engine in conjunction with automatic drives consists in that this decoupled condition is exactly present when on the selective lever of the automatic drive the position "DRIVE" or other driving stages are not selected.

Generally, with this direct correction of the precontrol of the idling speed of an internal combustion engine in accordance with FIG. 4, the idling speed set signal LS is always generated by connecting the regulator output signal RA with the performance graph precontrol signal KV, whereby in the decoupled operational condition of the internal combustion engine the values of the performance graph precontrol signal KV are corrected in dependency from the regulator output signal RA.

A simplification of the mode of operation of the block diagram of FIG. 4 resides in that when using the device in conjunction with motor vehicles, switch 25 is not closed in the decoupled condition of the internal combustion engine, but when the speed of the motor vehicle is smaller than a defined, predeterminable limit speed. This is advantageous in that all possible problems in conjunction with first adaptations of the device do not occur any longer. It is then particularly advantageous if the switch 25 of the block diagram of FIG. 4 can also be closed by external manipulation, for example, for diagnostic purposes. Thereby it is possible to take care of errors with less expense.

FIG. 5 illustrates a realisation of the correction device of FIG. 4. Reference numeral 30 designates an idling speed regulator with an I-component. The reference numerals 31 to 35 designated switches. Each multiplicator is designated with the reference numerals 36 to 41. The reference numerals 42 to 45 designate one each connecting location. Finally, one each integrator is designated with the reference numerals 46 to 49. The idling speed regulator 30 is admitted at its input with the speed differential signal ND. The idling speed regulator 30 generates an output signal in dependency of ND, namely the regulating output signal RA. This signal is fed to each of the switches 31 to 35. The free connecting point of switch 31 or 35 is connected to the connecting location 42 or 45, respectively. In contrast, the free connecting points of the switch 32 are connected with the multiplicators 36 and 37, switch 33 with the multiplicators 38 and 39, as well as the switch 34 with the multiplicators 40 and 41, respectively. Each of the multiplicators 36 to 41 is additionally admitted with a temperature dependent signal. These signals which are designated with the letters T11,T22,T21,T32,T31 and T42 will be described in detail later. Each of the multiplicators 36 to 41 generates an output signal, whereby the output signal of the multiplicator 36 is connected to the connecting location 42, the output signal of the multiplicator 41 to the connecting location 45, the output signals of the multiplicators 37 and 38 to the connecting location 43, as well as the output signals of the multiplicators 39 and 40 to the connecting location 44. Finally, each connecting location is connected with its output signal to one of the integrators, that is, the connecting location 42 to the integrator 46, the integration location 43 to the integrator 47, the connecting location 44 to the integrator 48, as well as the connecting location 45 to the integrator 49. The integrators 46 to 49 generate corresponding output signals in dependency from their given input signals being designated with the letters DW4, DW3,DW2 as well DW1.

The correction device in accordance with FIG. 5 operates in accordance with the following operating principle. In accordance with FIG. 3 the characteristics curve of the performance graph precontrol signals KV is divided into five ranges due to the four support locations TS1 . . . TS4. This division is performed in the realisation of the correcting device in accordance with FIG. 5 by means of the five switches 31 to 35. Of the five switches 31 to 35 only one always closes exactly and always the one which is associated with the temperature range in which the motor temperature $T_M$ is present. If the temperature of the motor $T_M$ is in a temperature range which is between the two outermost supporting locations, the regulator output signal RA is fed to two multiplicators through the given closed switch. Each of these two multiplicators is additinally admitted by a second input signal and forms an output signal in dependency from its two input signals with which it influences an integrator. The output signal of the integrator is then directly connected to the precontrol performance graph, for example, in FIG. 1 to the precontrol performance graph 20 or in FIG. 3 to the precontrol performance graph 27. The values of the performance graph precontrol signal are changed with the output values of the integrators.

By way of example, should the motor temperature $T_M$ be greater than the threshold value temperature TS2, however smaller than the threshold value temperature TS3. Consequently, only switch 3 would be closed in the block diagram of FIG. 5. The regulator output signal RA is then fed over switch 33 to the two multiplicators 38 and 39. As a further input signal the value T32 is fed to the multiplicator 38, and the multiplicator 39 is admitted with the value T21. The two multiplicators 38 or 39 generate one output signal in dependency from their two input signals being connected with the connecting locations 43 or 44. The second input signal of the two connecting points 43 and 44 is a zero, since the two switches 32 and 34 are opened. Thereby, the two output signals of the two multiplicators 38 or 39 are directly fed to the two integrators 47 or 48, respectively. The output signal of the two integrators 47 or 48 finally forms the correcting value DW3 or DW2. The two correcting values DW3 and DW 2 are now directly connected with the precontrol performance graph 27 of FIG. 3 and influence additively the values W3 and W2, for example. Generally, the characteristics curve of the performance graph precontrol signal KV of FIG. 3 is displaced with the assistance of the two correcting values.

If the motor temperature is outside of a temperature range which is limited by the two outermost temperature threshold values TS1 and TS4, the regulator output value is fed directly to the integrator over the given closed switch, without being multiplied with any other values. In this case the precontrol performance graph 27 of FIG. 4 is directly influenced by the integrator.

When looking at the characteristics curve of the performance graph precontrol signals KV of FIG. 3, only the two values of the output values W1 . . . W4 are corrected at a given motor temperature $T_M$ which limit the range in which the motor temperature is present. If the motor temperature is below the smallest temperature threshold or above the greatest temperature threshold, only the output value of this temperature threshold is corrected.

If one of switches 32 to 34 is closed, the regulator output signal RA, as already stated, is fed to one of the multiplicators 36 to 41. Each of these multiplicators, as already stated before, is admitted with a further input signal. For this input signal the generally following relationships are valid. If the motor temperature $T_M$ is larger than a first general temperature threshold TSX, however smaller than a second general temperature threshold TSY, the relationship $TX1=(TSY-T_m):(TSY-TSX)$ is valid for the second input signal of the multiplicator, whose output signal indirectly influences the correcting value DWX. For the second input signal of the second multiplicator, whose output signal influences the correcting value DWY, the relationship $TY2=(T_M-TSX):(TSY-TSX)$ is valid. The block diagram of FIG. 5 illustrates the given temperature ranges of switches 31 to 35 in four support locations selected in accordance with FIG. 3, also the input values of the multiplicators 36 to 41 are mentioned for the specific temperature range, which have the stated general value.

When the motor temperature is between two support locations, the two output values of the supporting locations are measured by the supporting locations depending on the distance of the motor temperature from the supporting faces. If the motor temperature is directly on one of the supporting locations, the output value on this supporting location is only measured with the factor one.

The described correction of the precontrol of the idling speed regulation of an internal combustion engine encompasses, in accordance with FIGS. 1 and FIG. 3, only the dependency of the correction from the precontrol from one variable. However, its is also possible to make the precontrol dependent from two variables. This does not result in two dimensional characteristics curves as illustrated in FIG. 3, for example, but three dimensional characteristics curves. Above all, with the assistance of the direct correction of the precontrol, as illustrated in the two block diagrams of FIGS. 4 and FIG. 5, it is possible in a particularly advantageous manner to correct these three dimensional performance graphs with the assistance of supporting locations and corresponding interpolations in a simple manner. The calculation of the correcting values for the individual support locations requires only a little more effort in comparison with the two dimensional characteristics curve. The equations for these correcting values result in analog form with respect to the stated general equations of the correcting values, as stated in conjunction with the block diagram of FIG. 5.

Figure 6:
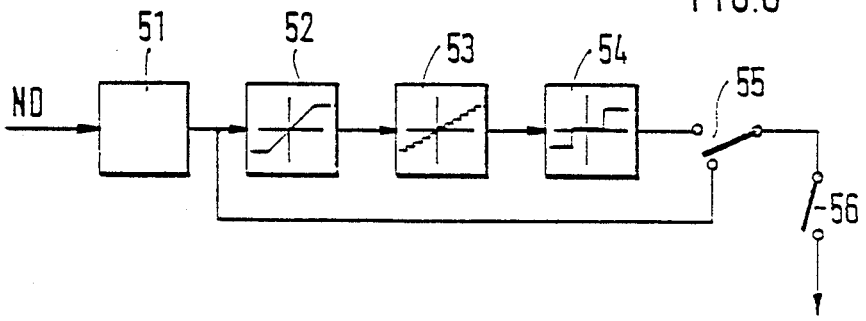
FIG. 6 is a schematic diagram of a further embodiment of the precontrol of the idling speed of an internal combustion engine.

FIG. 6 illustrates a further realisation of a correction of the precontrol of the idling speed regulation of an internal combustion engine. The reference numeral 51 designates an idling speed regulator with an I-component. Reference numeral 52 designates a limiting member, reference numeral 53 denotes a counter and reference numeral 54 indicates a dead time member. A reverse switch is denoted by reference numeral 55, while a switch is designated with reference numeral 56. The idling speed regulator 51 is admitted at its input with the speed differential signal ND and generates in dependency therefrom the regulating output signal RA. The limiting member 52, the counter 53, the dead time member 54 and one of the two connecting points of the reverse switch 55 form a series circuit, whereby the regulating output signal RA is fed at the input of the limiting member 52. The second connecting point of the reverse switch 55 is also admitted with the regulating output signal RA. Finally, the common connecting point of the reverse switch 55 is connected with the switch 56, whose free end influences the precontrol of the idling speed regulation of the internal combustion engine, either indirectly or directly.

The limiting member 52 has the task to limit the regulating output signal RA to defined, predeterminable small values. These limited regulating output signals are then summed up by the counter 53. So that not a every small change of the counting value of the counter 53 causes immediately a direct or indirect correction of the precontrol. The dead time member 54 has the task to generate an output signal only when the counting value of the counter 53 exceeds a defined, predeterminable value. In the normal driving operation the reverse switch 55 is so switched that it connects the dead time member 54 with switch 56. The reverse switch can only be brought into a different position for diagnostic purposes, for example, by means of an external manipulation, so that the limiting member 52, the counter 53, and the dead time member 54 are short circuited. The switch 56 is only closed when the internal combustion engine is not in its idling speed. Consequently, no correction of the precontrol occurs during the operating condition of the idling speed, but only outside of the idling speed operation. Again, it should be noted that the output signal of the switch 56 can indirectly correct the precontrol of the idling speed regulation analog with respect to FIGS. 1 and 2, on the one hand, and can also perform this correction directly, on the other hand, as illustrated in the FIGS. 3 to 5.

I claim:

1. Method for controlling and regulating the idling speed of the internal combustion engine, comprising the steps of generating operating characteristics signals which characterize an operational condition of the internal combustion engine with sensors, providing an idling speed regulator (10) having an integral component, providing a precontrol (20) of the idling speed of the internal combustion engine depending from the temperature as one of the operational values of the internal combustion engine for generating precontrol signals (KV), providing precontrol correcting means and regulating the idling speed by said regulator in dependency from the precontrol of the idling speed, wherein the precontrol is corrected in dependency from the operational condition of the internal combustion engine by adding temperature-dependent correcting signals from a connecting point (14) between said precontrol and said correcting means to said precontrol signals.

2. Method in accordance with claim 1, characterized in that the precontrol is directly controlled by changing the values of the precontrol.

3. Method in accordance with claim 1, wherein the precontrol is only corrected in the decoupled operational condition of the internal combustion engine.

4. Method in accordance with claim 3, wherein the internal combustion engine is exactly in its decoupled operational condition when the amount of the speed difference between a desired regulation speed and the actual speed is below a defined, predeterminable speed differential threshold and when the output signal of the idling speed regulator is also below a defined, predeterminable threshold.

5. Method in accordance with claim 3, wherein the internal combustion engine is exactly in its decoupled operational stage when a drive speed drop of the internal combustion engine falls below a defined, predeterminable value.

6. Method in accordance with claim 5, wherein in an internal combustion engine with an automatic-drive-switch the precontrol is corrected only when the automatic-drive-switch is not in a drive position.

7. Method in accordance with claim 1, wherein the precontrol is corrected only when the drive speed of a motor vehicle being driven by the internal combustion engine falls below a defined, predetermined drive speed.

8. Method in accordance with claim 1, wherein the precontrol is only corrected when the internal combustion engine is in maintenance.

9. Method in accordance with claim 1, wherein the precontrol is divided into a plurality of ranges by means of equations.

10. Method in accordance with claim 9, wherein the total precontrol is corrected.

11. Method in accordance with claim 1, wherein the precontrol is stated by means of individual support locations and intermediately disposed corresponding interpolations.

12. Method in accordance with claim 11, wherein only the support locations are corrected.

13. Method in accordance with claim 1, wherein the precontrol depends not only from one, but from a plurality of variables.

14. Device for controlling and regulating the idling speed of an internal combustion engine, comprising sensors for generating operating characteristics signals which characterize an operational condition of the internal combustion engine, computer means providing idling speed control and a precontrol of the idling speed control of the internal combustion engine depending from the temperature as one of the operational values of the internal combustion engine, means for regulating the idling speed in dependency from the precontrol of the idling speed, and means for correcting the precontrol in dependence from the operational condition of the internal combustion engine by adding temperature-dependent correcting signals to precontrol signals.

15. Device in accordance with claim 14, wherein the precontrol correcting means include at least one intergrator.

16. Device in accordance with claim 14, wherein at least one multiplicator is used in said means for correcting precontrol.

17. Device in accordance with claim 14, wherein the total precontrol is influenced with the assistance of the means for correcting the precontrol.

18. Device in accordance with claim 14, wherein the means for correcting the precontrol influence only support values of the precontrol.

19. Device in accordance with claim 18, wherein only neighboring support values are influenced.

* * * * *